US007600534B2

(12) United States Patent
Deaton

(10) Patent No.: US 7,600,534 B2
(45) Date of Patent: Oct. 13, 2009

(54) VALVE CLOSING DEVICE

(75) Inventor: Tomas Michael Deaton, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 768 days.

(21) Appl. No.: 10/958,438

(22) Filed: Oct. 5, 2004
(Under 37 CFR 1.47)

(65) Prior Publication Data

US 2005/0067601 A1 Mar. 31, 2005

Related U.S. Application Data

(62) Division of application No. 10/105,762, filed on Mar. 25, 2002, now Pat. No. 6,705,593.

(51) Int. Cl.
*E21B 34/06* (2006.01)
*F16K 15/03* (2006.01)

(52) U.S. Cl. ..... 137/527; 251/303; 251/337; 166/332.8

(58) Field of Classification Search ..... 251/177, 251/301, 303, 337; 166/332.8; 137/527
See application file for complete search history.

(56) References Cited

U.S. PATENT DOCUMENTS 3,640,306 A 2/1972 Vogt
4,027,695 A * 6/1977 Schnatmeyer et al. ..... 137/527
4,196,745 A 4/1980 Schutzer
5,137,090 A * 8/1992 Hare et al. ..... 166/325
6,328,062 B1 * 12/2001 Williams et al. ..... 251/303

FOREIGN PATENT DOCUMENTS

CH 601710 A5 7/1978
GB 2345742 A * 7/2000
GB 2388383 A * 11/2003

* cited by examiner

*Primary Examiner*—Robin O Evans
*Assistant Examiner*—Andrew J Rost
(74) *Attorney, Agent, or Firm*—James L. Kurka; Daryl R. Wright; Trop, Pruner, Hu PC

(57) ABSTRACT

An apparatus capable of moving a shiftable valve member into a closed position, the shiftable valve member mounted in a valve housing having a bore and being moveable between at least one open and at least one closed position relative to the bore, includes at least one elastically deformable member that extends at least partially around the circumference of the bore and is disposed at least partially in a cavity in the valve housing. Each elastically deformable member is elongated, has first and second ends and is connected to the shiftable valve member at one location and to the valve housing at least one other location. Each elastically deformable member is torsionally loaded to provide biasing, closing force to the shiftable valve member to assist in moving the shiftable valve member into a closed position and retaining it in the closed position.

13 Claims, 8 Drawing Sheets

VALVE CLOSING DEVICE

CROSS REFERENCE TO RELATED APPLICATIONS

This application is a divisional of patent application Ser. No. 10/105,762, filed in the U.S. Patent and Trademark Office on Mar. 25, 2002 now U.S. Pat. No. 6,705,593.

BACKGROUND OF THE INVENTION

The invention relates to flow control devices having one or more shiftable valve members. More particularly, the invention relates to apparatus and methods for moving a shiftable valve member from an open to a closed position.

Fluid flow operations often involve the use of flow control devices having shiftable valve members that can be opened and closed to control fluid flow thereby. Mechanisms are thus necessary to enable movement of the shiftable valve members from open to closed positions. For example, conventional oil and gas well operations commonly utilize flow control devices that can be closed to shut off fluid flow and opened to allow fluid flow thereby, or otherwise provide access into and through the flow control device. For a particular example, flapper type safety valves are commonly located in well tubing and include a flapper member movable between open and closed positions.

Mechanisms for closing flow control devices have been proposed. For example, U.S. Pat. No. 4,624,315 to Dickson et al., U.S. Pat. No. 4,411,316 to Carmody, U.S. Pat. No. 3,786,866 to Tausch et al. and U.S. Pat. No. 4,660,646 to Blizzard each discloses a spring engaged with the shiftable flapper member of a flapper type valve assembly and disposed around a hinge pin to bias the flapper member into a closed position. U.S. Pat. No. 5,137,090 to Hare et al. discloses a curved beam type spring mounted within the tubular body of a flapper valve and an arm that engages the flapper member for yieldably urging the flapper member toward its closed position. For yet another example, U.S. Pat. No. 4,531,587 to Fineberg discloses the use of a pair of helical torsion springs engaged with hinge pins which are integral to the flapper member for biasing a flapper member to its closed position.

With respect to each of the above-cited patents, it is important to understand that the features mentioned above are merely examples of features disclosed in the patents. There are numerous other features disclosed in each patent in addition to the features mentioned herein. The additional features can be readily understood from a thorough review of each respective patent. The brief discussion above is included only to introduce the subject matter of the patents and not to distinguish the same from the present invention. Therefore, it is the patent applicant's intent that the brief remarks above about the cited patents not, in any way, limit or affect the scope of any of the appended claims. A comparison of any of the above-cited patents with the invention of any of the appended claims should involve a comparison of all features of the cited patent together as compared with the entirety of the selected claim(s).

In considering existing technology for closing the shiftable valve member of a flow control device, there remains a need for apparatus and methods having one or more of the following attributes: ensuring the shiftable valve member remains closed when in a closed position; an apparatus that is strong and reliable in the environment within which it is used; an apparatus that may be used in a dual spring configuration to provide added biasing force for yieldably urging the shiftable valve member in a closed position; an apparatus that requires or occupies minimal or no additional length in the flow control device or the conduit within which the flow control device is located.

BRIEF SUMMARY OF THE INVENTION

In accordance with the present invention, certain embodiments involve an apparatus capable of moving a shiftable valve member into a closed position and retaining it in the closed position. The shiftable valve member is mounted in a valve housing having a bore and is moveable between at least one open and at least one closed position relative to the bore. A first spring assembly is engageable with the shiftable valve member, moves the shiftable valve member into a closed position and assists in retaining it in the closed position. A second spring assembly including at least one elastically deformable member that extends at least partially around the circumference of the bore and is disposed at least partially in a cavity in the valve housing. Each elastically deformable member is elongated, has first and second ends and is connected to the shiftable valve member at one location and to the valve housing at one or more other locations. Each elastically deformable member is torsionally loaded to provide biasing, closing force to the shiftable valve member to assist in moving the shiftable valve member into a closed position and retaining it in the closed position. The second spring assembly may include a single elastically deformable member connected at its first and second ends to the valve housing and therebetween to the shiftable valve member.

The second spring assembly may include first and second elastically deformable members, each of the first and second elastically deformable members connected at its first end to the shiftable valve member and at its second end to the valve housing. The elastically deformable members may be non-rigidly connected with the valve housing. The apparatus may include an arm engageable between the shiftable valve member and the elastically deformable members. The elastically deformable members may be non-rigidly connected with the shiftable valve member.

The shiftable valve member may be a flapper valve member disposed in a subsurface well conduit and the elastically deformable member may have a generally elliptical, rectangular, circular or other shaped cross section. The elastically deformable member(s) may include a plurality of wires and/or be constructed of metals, single strands of wire or composites. The apparatus may have an arm engageable between the shiftable valve member and the elastically deformable member(s).

Certain embodiments of the present invention involve a flapper valve closing device for moving a flapper valve member into a closed position and retaining it in the closed position under normal operating conditions, where the flapper valve member is disposed in a valve housing and is useful in an underground oilfield tubular. The valve housing has a bore and the flapper valve member is hingeably moveable between at least one open and at least one closed position relative to the bore. The flapper valve closing device includes an elastically deformable member extending at least partially around the circumference of the bore and disposed at least partially in a cavity formed in the valve housing. The elastically deformable member is elongated, has first and second ends, and is connected with the valve housing at its first and second ends and with the flapper valve member therebetween. The elastically deformable member is torsionally loaded to provide biasing, closing force upon the flapper valve member to move the flapper valve member into a closed position and retain the flapper valve member in the closed position during normal operating conditions.

The flapper valve closing device may include a pivotable arm assembly having at least one rotatable hinge pin and an arm engageable with the flapper valve member, the elastically deformable member being connected with the pivotable arm assembly. The elastically deformable member may be non-helical, may be non-rigidly connected with the valve housing and may have a generally elliptical cross-section, or any combination or none such features.

In certain embodiments, the present invention involves a safety valve for use in an oilfield tubular and including a housing having a longitudinal bore extending therethrough and a flapper valve member mounted in the housing. The flapper valve member is hingeably movable relative to the longitudinal bore and has an open position allowing fluid flow through the longitudinal bore and a closed position disallowing fluid flow through the longitudinal bore. The safety valve includes first and second springs engageable with the flapper valve member. The second spring includes at least one elongated elastically deformable member disposed at least partially around the circumference of the longitudinal bore. Each elongated elastically deformable member is associated with the flapper valve member at one location and with the housing at one or more other locations. The first and second springs provide biasing forces to move the flapper valve member into a closed position. The second spring may include first and second elongated elastically deformable members, each elongated elastically deformable member being connected at its first end to the flapper valve member and at its second end to the housing.

Various embodiments of the present invention involve a subsurface safety valve for use in an oilfield tubular that includes housing means having a longitudinal bore extending therethrough and shiftable valve means mounted in the housing means for allowing and disallowing fluid flow through the longitudinal bore. The shiftable valve means has an open position capable of allowing fluid flow through the longitudinal bore and a closed position capable of at least partially blocking fluid flow through the longitudinal bore. The safety valve also includes first and second spring means for urging the shiftable valve means into a closed position and retaining it in the closed position. The second spring means is elastically deformable and disposed at least partially around the circumference of the longitudinal bore.

In accordance with the present invention, certain embodiments involve a method of moving a shiftable valve member of a subsurface safety valve into a closed position with the use of a valve closing device. The shiftable valve member is disposed in a housing having a bore and the valve closing device includes at least one elongated elastically deformable member disposed at least partially around the circumference of the bore. Each elongated elastically deformable member is connected with the shiftable valve member at one location and with the housing at least one other location. The method includes actuating the valve opening device to move the shiftable valve member out of a closed position and cause the at least one elongated elastically deformable member to twist, and releasing the valve opening device. The at least one elongated elastically deformable member will attempt to untwist, applying biasing force to the shiftable valve member to move it into a closed position and retain it in the closed position.

Accordingly, the present invention includes features and advantages which enable it to substantially advance the technology associated with moving a shiftable valve member into a closed position. Characteristics and advantages of the present invention described above, as well as additional features and benefits, will be readily apparent to those skilled in the art upon consideration of the following detailed description of preferred embodiments and referring to the accompanying drawings.

BRIEF DESCRIPTION OF THE DRAWINGS

For a detailed description of the preferred embodiments of the invention, reference will now be made to the accompanying drawings wherein.

DETAILED DESCRIPTION OF PREFERRED EMBODIMENTS

Figure 1:
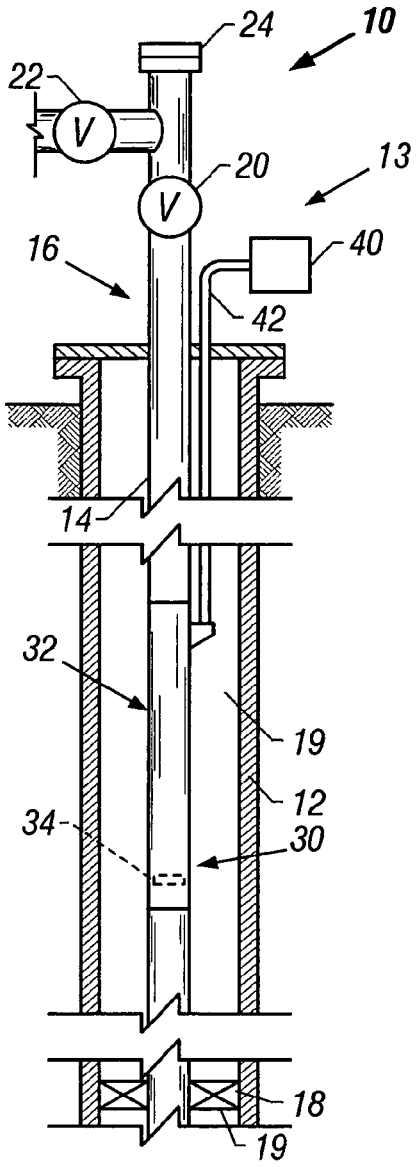
FIG. 1 (Prior Art)
FIG. 1 is a schematic view in section and elevation of a typical well completion including a subsurface safety valve.

Presently preferred embodiments of the invention are shown in the above-identified figures and described in detail below. In describing the preferred embodiments, like or identical reference numerals are used to identify common or similar elements. The figures are not necessarily to scale and certain features and certain views of the figures may be shown exaggerated in scale or in schematic in the interest of clarity and conciseness.

The contents of this "Detailed Description of Preferred Embodiments", the accompanying "Abstract", "Brief Description of the Drawings", "Brief Summary of the Invention" and "Background of the Invention" sections and appended FIGS. 1-10 are not intended and should not be deemed to limit the scope or construction of any of the appended claims or claim language, except and only to the extent as may be expressly provided in the form of a specific definition contained in this Detailed Description section for particular language that may appear in one or more of the appended claims, such specific definition(s) including the phrase "the term '_____' means". Further, as used herein and throughout the various portions of this specification, the terms "invention", "present invention" and variations thereof are used to generally refer to subject matter that may be encompassed by one or more of the appended claims, but not as a limitation of any claims. These terms are not intended to, and do not, mean the claimed invention of any particular claim(s), or of all of the appended claims. Thus, the use herein of the terms "invention", "present invention" and variations thereof should not be used to limit the construction or scope of any of the appended claims.

Referring to FIG. 1, an exemplary environment within which the present invention may be used is shown as a conventional oil and gas production well or well completion 10, as is known in the art. The illustrated well completion 10 includes a casing string 12 extending from the well surface 13 to a hydrocarbon production formation (not shown). A tubing string 14 is shown concentrically disposed within the casing string 12, and extends from a wellhead 16 through a production packer 18. The production packer 18 of FIG. 1 seals the annulus formed between the tubing and casing strings 14, 12, and directs formation fluids, such as oil, gas and water, into the tubing string 14 that are admitted into the well bore 19 through perforations (not shown) in the casing string 12. Valves 20, 22, which are helpful in controlling fluid flow from the tubing string 14, are shown at the well surface 13. A wellhead cap 24 is useful, for example, to permit servicing the well 10 via tubing string 14 with wireline equipment (not shown).

Still referring to the exemplary environment of FIG. 1, a flow control device 30 having a shiftable valve member 37 (FIGS. 2A, 2B) is installed in the well 10 as a part of the tubing string 14 to assist in controlling fluid flow to the well surface 13 through the tubing string 14 from downhole, as is also known in the art. The illustrated flow control device 30 is a surface-controlled subsurface safety valve 32 connected in the tubing string 14, such as by suitable threaded connections. The device 30 may be operated, for example, by control fluid conducted from a hydraulic manifold 40 at the well surface through a control line conduit 42. Further explanation of the components, arrangement and operation of a conventional well completion and related equipment can be found in prior art patents and other publications, such as U.S. Pat. Nos. 4,723,606, 4,624,315 and 5,127,476, each of which is hereby incorporated by reference herein in its entirety.

The above description and further aspects of a conventional well completion having one or more underground oilfield tubulars and a subsurface safety valve are known in the art and in no way limiting upon the present invention or the appended claims. Moreover, the present invention is not limited to use in the environment of a well completion, oil and gas production well or oilfield tubular, but may be used in any environment where it is desired to move one or more shiftable valve members of a flow control device disposed in a fluid flow apparatus or system from an open to a closed position.

Figure 2A:
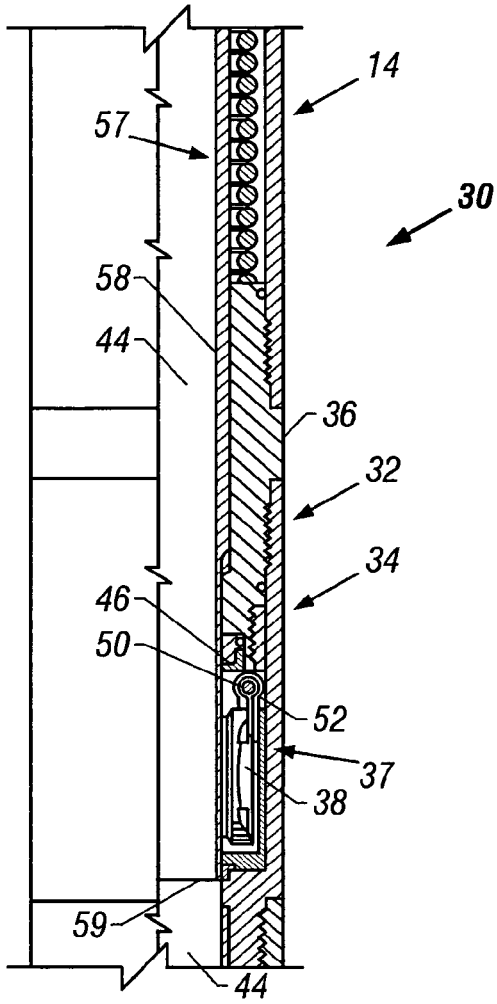
FIG. 2A (Prior Art)
FIG. 2A is a fragmentary elevational view, partly in cross section, showing a typical flapper type safety valve in an open position.
Figure 2B:
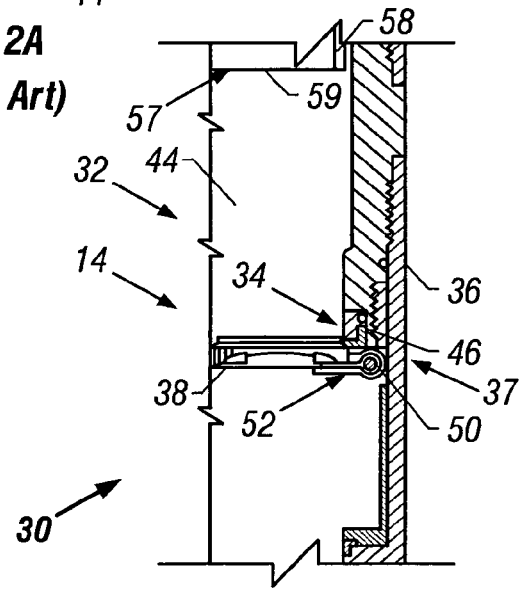
FIG. 2B (Prior Art)
FIG. 2B is a fragmentary elevational view, partly in cross section, showing a typical flapper type safety valve in a closed position.

Now referring to FIGS. 2A and 2B, the illustrated safety valve 32 is a flapper-type valve assembly 34 generally including a valve housing, or body, 36 and a (shiftable) flapper member 38. The exemplary flapper member 38 is pivotably mounted in the valve housing 36 and is movable between at least one open position, such as shown in FIG. 2A, and at least one closed position such as shown in FIG. 2B, relative to a central, longitudinally extending bore 44 through the valve housing 36.

To move the illustrated flapper member 38 from a closed to an open position a valve opening device 57 is typically used. The valve opening device 57 may be any among a variety of suitable devices that are, or in the future, become known in the art. In the configuration shown, for example, the valve opening device 57 is a reciprocating tubular member 58 movable downwardly into contact with the flapper member 38 to push it off of a valve seat 46 into an open position, as is known in the art. By maintaining a downward position of the tubular member 58, the flapper member 38 is (at least temporarily) held in an open position, such as to permit fluid flow through the bore 44 and tubing 14, if desired. It should be understood, however, that the present invention is not limited to use with a tubular member type valve opening device, but may be used with any suitable type of valve opening device or technique. Moreover, the use of a valve opening device or technique is not required by the present invention, as the present invention is directed to the closing of a shiftable valve member. Therefore, the present invention is in no way limited by the device or manner (if any) that is, or may be, used for moving the shiftable valve member into an open position.

Still referring to the conventional configuration of FIGS. 2A and 2B, to allow the flapper member 38 to move from an open to a closed position, the valve opening device 57 (if used) is disengaged. In the illustrated device, the tubular member 58 is moved upwardly out of engagement with the flapper member 38. As the lower end 59 of the tubular member 58 moves above the valve seat 46, the biasing force of a spring assembly 52 (and possibly also the upward fluid flow through the tubing string 14 and bore 44) moves the flapper member 38 into a closed position, as is known in the art. In FIG. 2B, the flapper member 38 is shown yieldably urged about a pin 50 by the spring assembly 52 into a closed position.

Figure 3A:
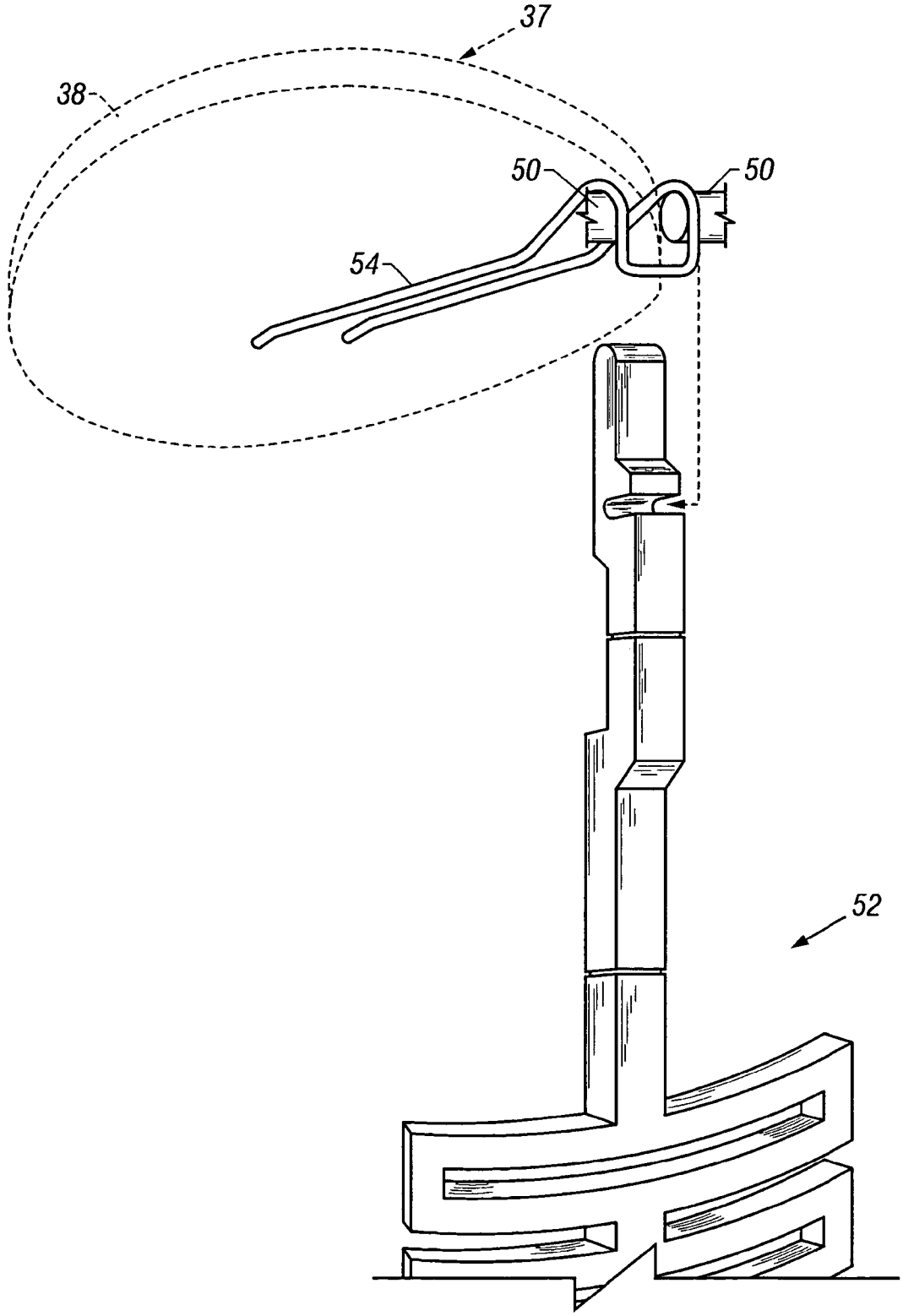
FIG. 3A (Prior Art)
FIG. 3A is a perspective, exploded view of a prior art arm and spring for urging a flapper member to a closed position as disclosed in U.S. Pat. No. 5,137,090.
Figure 3B:
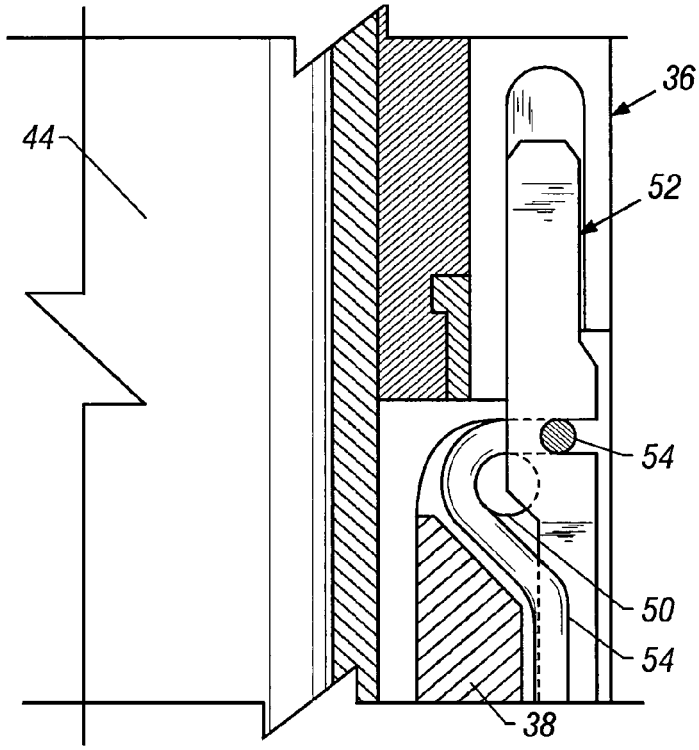
FIG. 3B (Prior Art)
FIG. 3B is a detailed, section view showing the connection of the spring to the arm of the prior art embodiment of FIG. 3A when the flapper member is in an open position.
Figure 3C:
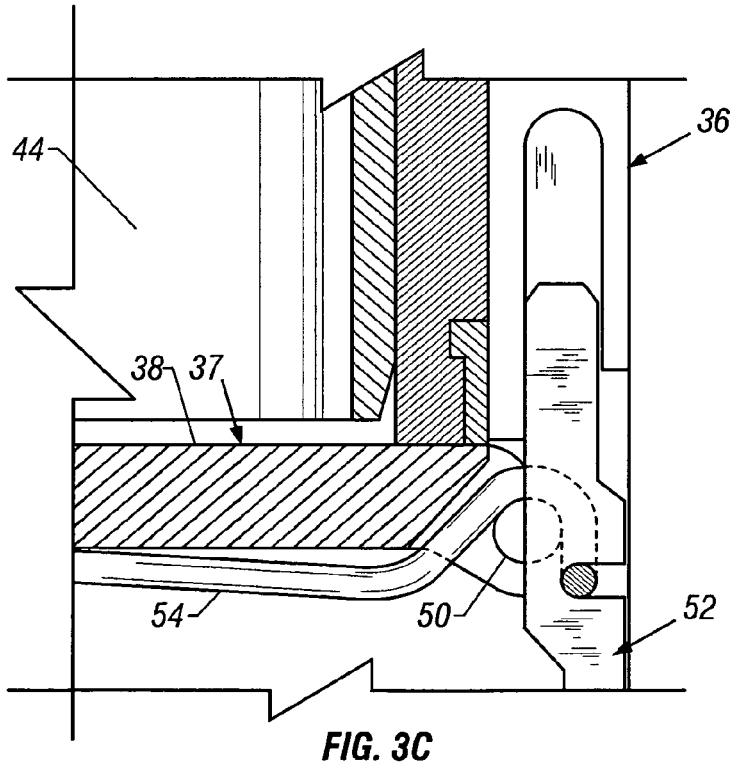
FIG. 3C (Prior Art)
FIG. 3C is a view similar to FIG. 3B, but showing the connection of the spring to the arm when the flapper member is in a closed position.

The components, arrangement and operation of flow control devices having shiftable valve members, such as conventional flapper type valve assemblies, and related components are more fully described in prior art patents and other publications, such as U.S. Pat Nos. 3,786,865, 3,786,866, 4,624,315, 5,127,476, 4,411,316, 4,356,867 and 4,723,606, each of which is hereby incorporated by reference herein in its entirety. For example, FIGS. 3A-3C illustrate an embodiment of a prior art flapper member 38 rotatable about pins 50 and which is urged into a closed position (FIG. 3C) by a spring assembly 52 and arm 54. The details of construction and operation of the configuration of FIG. 3A-3C can be found in U.S. Pat. No. 5,137,090 issued on Aug. 12, 1992 to Hare et al., which is hereby incorporated by reference herein in its entirety. It should be understood that the above description and further aspects of flow control devices with shiftable valve members, such as flapper type valve assemblies are in no way limiting upon the present invention or the appended claims.

Figure 4:
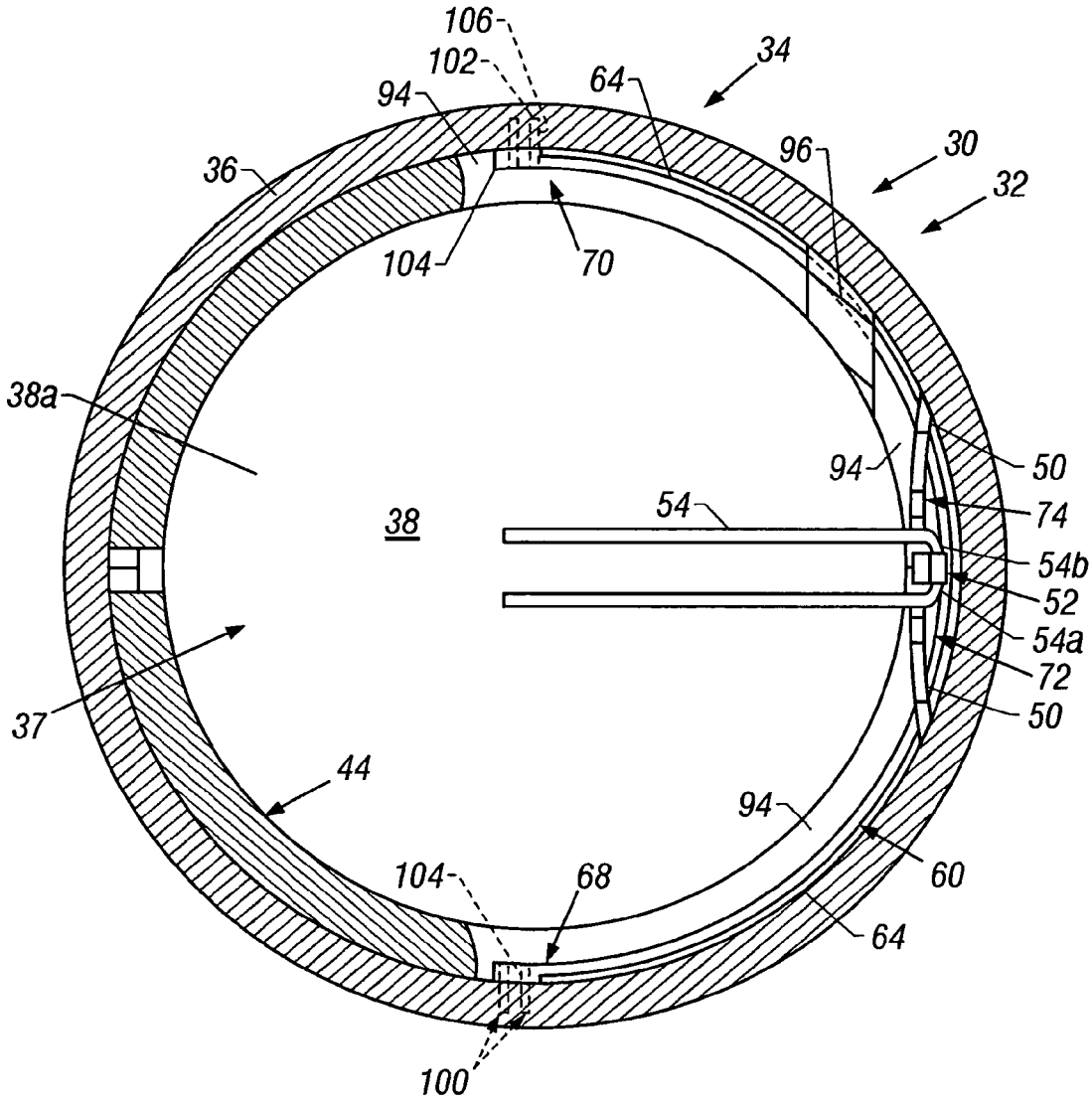
FIG. 4 is a sectional bottom view of an embodiment of a shiftable member closing device having a pair of elastically deformable members in accordance with the present invention shown along with another spring assembly in a flapper-type valve assembly.
Figure 5:
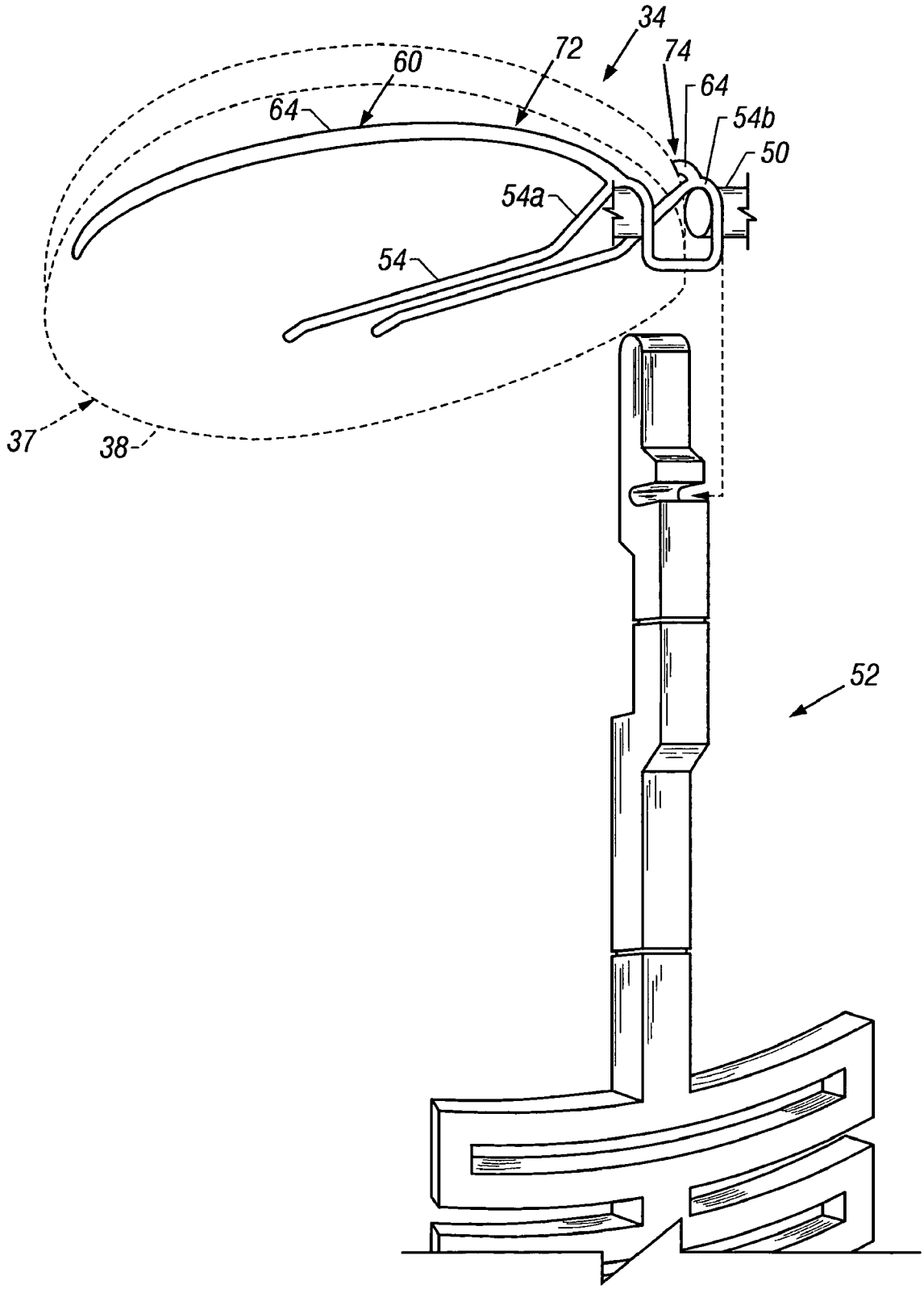
FIG. 5 is a perspective, exploded view of the shiftable member closing device of FIG. 4.

Referring now to FIGS. 4 and 5, one embodiment of a shiftable member closing device made in accordance with the present invention is identified with reference numeral "60" and shown in a dual spring configuration along with another spring assembly (52) in use with a flapper type valve assembly 34. As used throughout this patent specification and in the appended claims, the terms "spring assembly", "spring" and variations thereof means one or more structural members of any suitable form, construction, configuration and operation that is engageable with a shiftable valve member of a flow control device and capable of moving the shiftable valve member from an open position to a closed position. Further, as used throughout this patent specification and in the appended claims, the terms "connected to", "engageable with", similar terms and variations thereof means either directly or indirectly connected or connectable with.

It should also be understood that the exemplary shiftable member closing device 60 is described herein and shown in the appended drawings in connection with a flapper type valve assembly 34 (in a subsurface oilfield tubular) for illustrative purposes only. The present invention is useful with any other suitable type of flow control device having one or more shiftable valve members and in any other suitable environment. Further, the shiftable member closing device 60 of the present invention, when used in a dual spring configuration, is in no way limited to use with the illustrated spring assembly 52, but may be used with any suitable type of spring assembly. Thus, the (other) spring assembly with which the present invention is used in a dual spring configuration may be of any suitable type, form, configuration and operation. Moreover, the present invention is in no way limited by the type, form, configuration and operation of such (other) suitable spring assembly.

Still referring to the embodiment of FIGS. 4 and 5, the illustrated shiftable member closing device 60 includes a pair of elastically deformable members 64 extending generally laterally from the left and right sides 54*a*, 54*b* of the arm 54 and anchored at or near their respective back ends 68, 70 (FIG. 4) to the valve housing 36. As used throughout this patent specification and in the appended claims, the term "elastically deformable member" and variations thereof means an elongated item constructed of one or more components, capable of elastic deformation and connectable at one or more locations with the shiftable valve member and at one or more other locations with a component that is generally stationary relative to the shiftable valve member.

The exemplary elastically deformable members 64 shown in FIGS. 4 and 5 each have a generally semi-circular shape and a generally elliptical cross-section. However, any other suitable shape, cross-section and configuration may be used. For example, each deformable member 64 may take the form of multiple elongated members, such as wires 73 of FIG. 7, cables (not shown) or springs (not shown), bound or carried together, or otherwise connected or held, such as in a covering 75.

The members 64 are constructed of a material capable of elastic deformation. In the embodiment of FIGS. 4 and 5, for example, the members 64 are constructed of a spring material, such as MP3SN or ELGILOI, that will remain within its elastic region under stresses caused by the expected or desired amount of displacement or torque that it will undergo. Thus, the exemplary members 64 should not experience plastic deformation under such stresses, which could lead to failure and breakage. However, any other suitable material or material combinations may be used.

Figure 8:
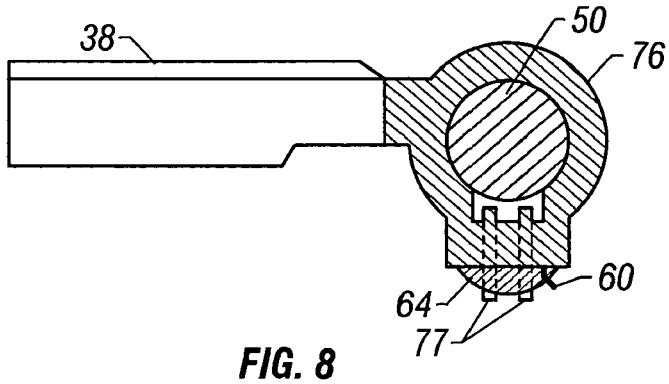
FIG. 8 is an isolated view, partly in cross section, showing the connection of an alternate embodiment of an elastically deformable member to a flapper member in accordance with the present invention.

Still referring to the embodiment of FIGS. 4 and 5, the respective front ends 72, 74 of the illustrated elastically deformable members 64 are integrally formed with an arm 54. However, any suitable techniques and/or apparatus for connecting the members 64 and arm 54 may be used, such as with the use of mechanical connectors. Further, the members 64 may be connected directly to the flapper member 38 (such as when no arm 54 is included), or to both the flapper member 38 and arm 54. Yet further, the shiftable member closing device 60 may take the form of a single unitary elastically deformable member 64 that connects to the arm 54, the flapper member 38 or both. For example, a single unitary member 64 may be connectable to the flapper member 38 equidistant from its ends with the use of a bracket 76 and bolts 77, such as shown in FIG. 8.

Referring again to FIG. 4, the exemplary elastically deformable members 64 extend into a cavity, or cavities, 94 formed in the valve housing 36 at least partially around the circumference of the housing bore 44. The cavity (or cavities) 94 provide sufficient space to allow the members 64 to bend and twist, or deform, therein. Further, one or more cavity 94 may be formed with a retaining portion at least partially surrounding or encapsulating the member 64 disposed therein, such as, for example, the retaining wall 96 of FIG. 4, such as to prevent the member 64 from jumping out of the cavity 94.

Still referring to FIG. 4, the back ends 68, 70 of the depicted elastically deformable members 64 are connected to the valve housing 36 sufficient to cause the members 64 to twist when the flapper member 38 is rotated out of a closed position. For example, a pair of connectors 100 may be used to rigidly connect each back end 68, 70 directly to the housing 36. The illustrated connectors 100 are screws 102 extendable through holes 104 formed in the ends 68, 70, respectively, and into holes 106 in the housing 36. However, any other suitable mechanism or technique may be used to connect the elastically deformable members 64 to the housing 36 or other structure that is stationary relative to the shiftable valve member 37. Further, the members 64 need not be connected at their back ends 68, 70, respectively, but may be connected at any other suitable, desirable location. Yet further, the members 64 need not be rigidly connected to the housing 36 or other structure, if it is desired to allow some movement of the member(s) 64 at the area(s) of connection.

Figure 6A:
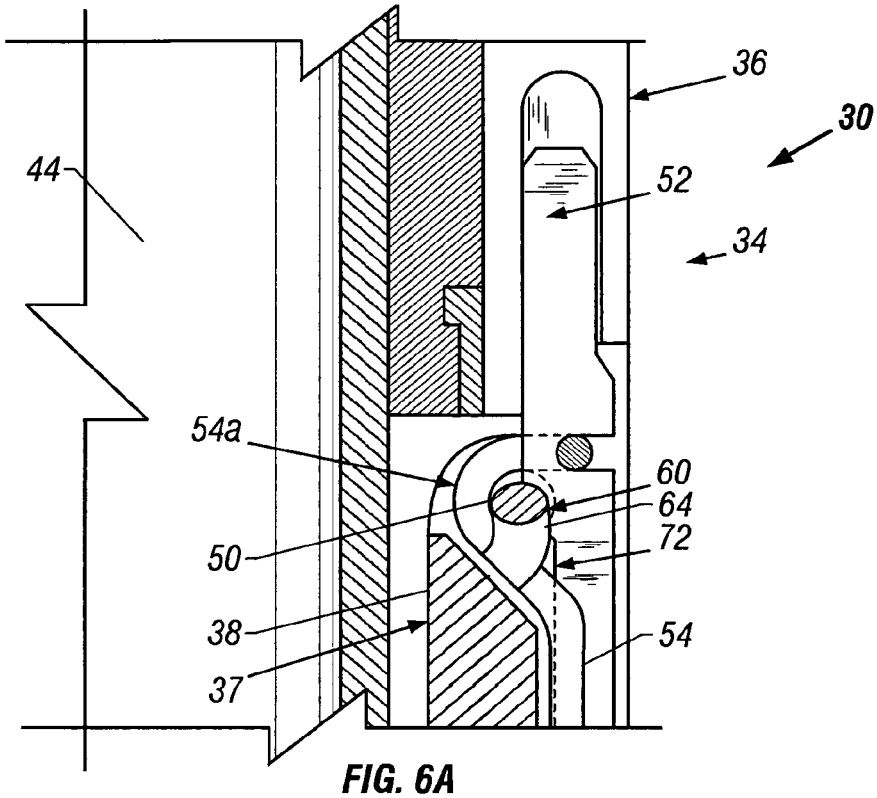
FIG. 6A is a detailed, sectional view of the front end of one of the elastically deformable members of FIG. 4 when the flapper member is in an open position.
Figure 6B:
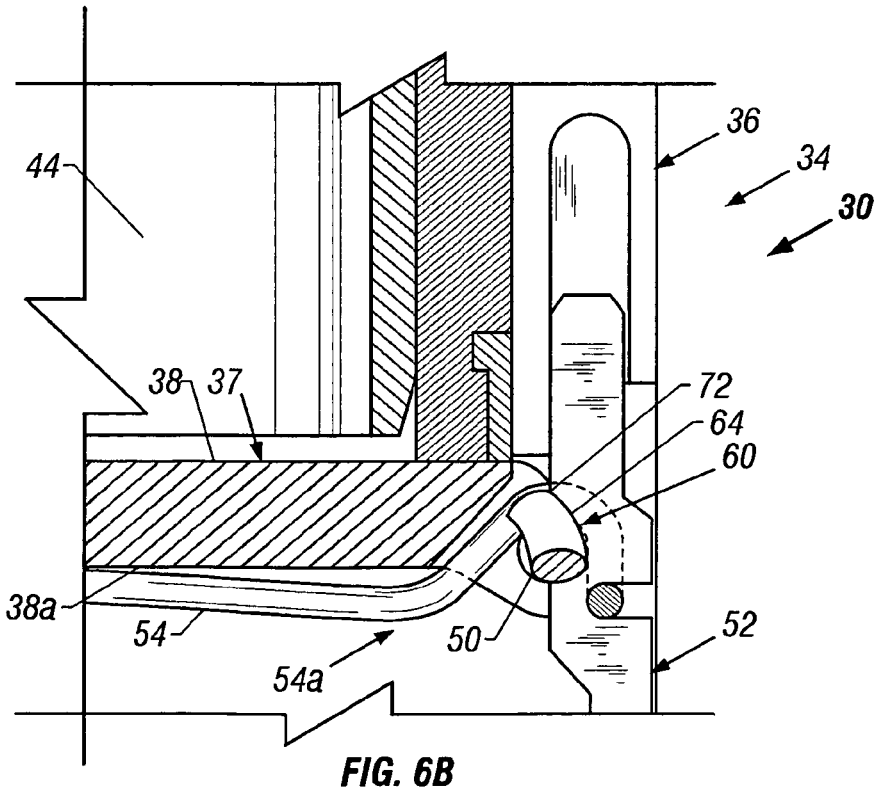
FIG. 6B is a view similar to FIG. 6A, but showing the front end of the elastically deformable member when the flapper member is in a closed position.
Figure 7:
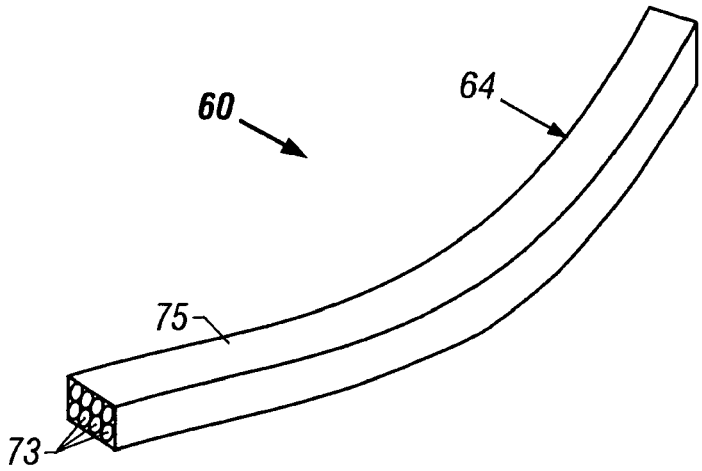
FIG. 7 is a perspective, exploded view of an alternate embodiment of an elastically deformable member in accordance with the present invention.

In operation, the shiftable member closing device 60 of the present invention is capable of biasing, or assisting in biasing, the shiftable valve member 37 into a closed position and holding it in a closed position under normal operating conditions. In the embodiment of FIGS. 4 and 5, for example, as the flapper member 38 is opened, or rotated out of a closed position, the elastically deformable members 64 (being connected to the arm 54 mounted to the bottom surface 38*a* of the flapper member 38) will also move, or attempt to rotate along with the flapper member 38. However, because the elastically deformable members 64 are connected at their back ends 68, 70 to a component that remains stationary relative to the moving flapper member 38, the back ends 68, 70 will resist rotation and cause the members 64 to elastically deform, or twist, generating torque or spring action. For example, as the illustrated flapper member 38 is caused to pivot approximately ninety degrees from a fully closed position (such as shown in FIG. 6B) to a fully open position (such as shown in FIG. 6A), the angular displacement of the exemplary elastically deformable members 64 between their front and back ends may increase by approximately ninety degrees.

Referring again to the embodiment of FIG. 4, the torque of the elastically deformable members 64 is transferred to the arm 54 and flapper member 38. As the opening, or downward, force on the illustrated flapper member 38 is reduced or removed, the torque of the exemplary elastically deformable members 64, together with the spring force of the spring assembly 52 (such as described in U.S. Pat. No. 5,137,090 at Col. 3, line 64 through Col. 5, line 23), yieldably urges the arm 54 and flapper member 38 into a closed position. When the flapper member 38 is in a closed position, the exemplary elastically deformable members 64 and the spring assembly 52 will have residual torsional stress or biasing force sufficient to retain the flapper member 38 in a closed position. To open the flapper member 38, downward force must be applied to the member 38 sufficient to overcome the biasing forces of the elastically deformable members 64 and the spring assembly 52.

Figure 9:
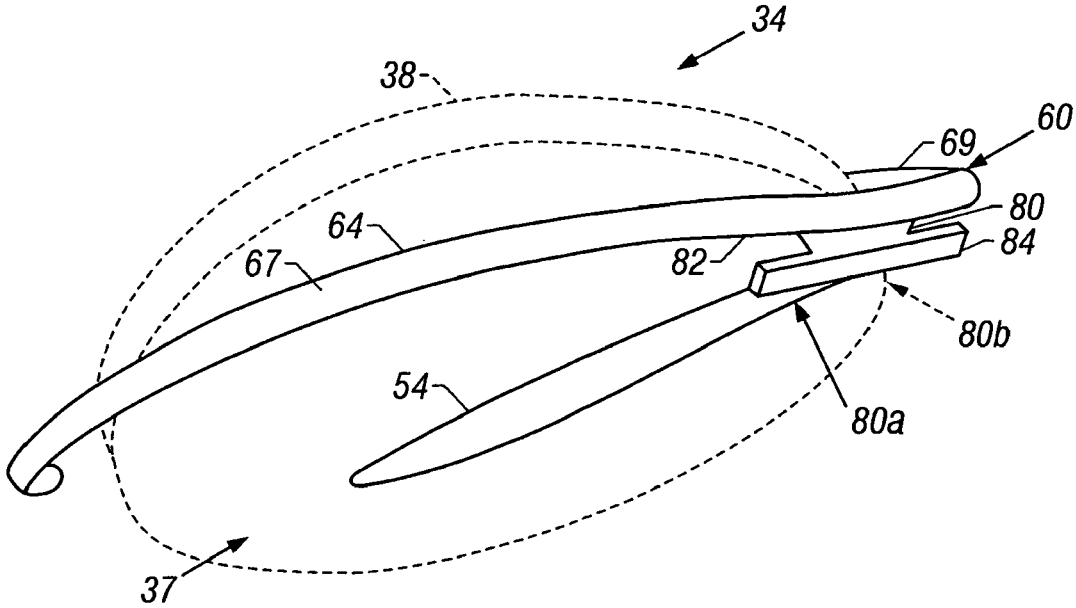
FIG. 9 is a perspective, exploded view of an alternate embodiment of a shiftable member closing device used with a flapper-type valve assembly in accordance with the present invention.
Figure 10:
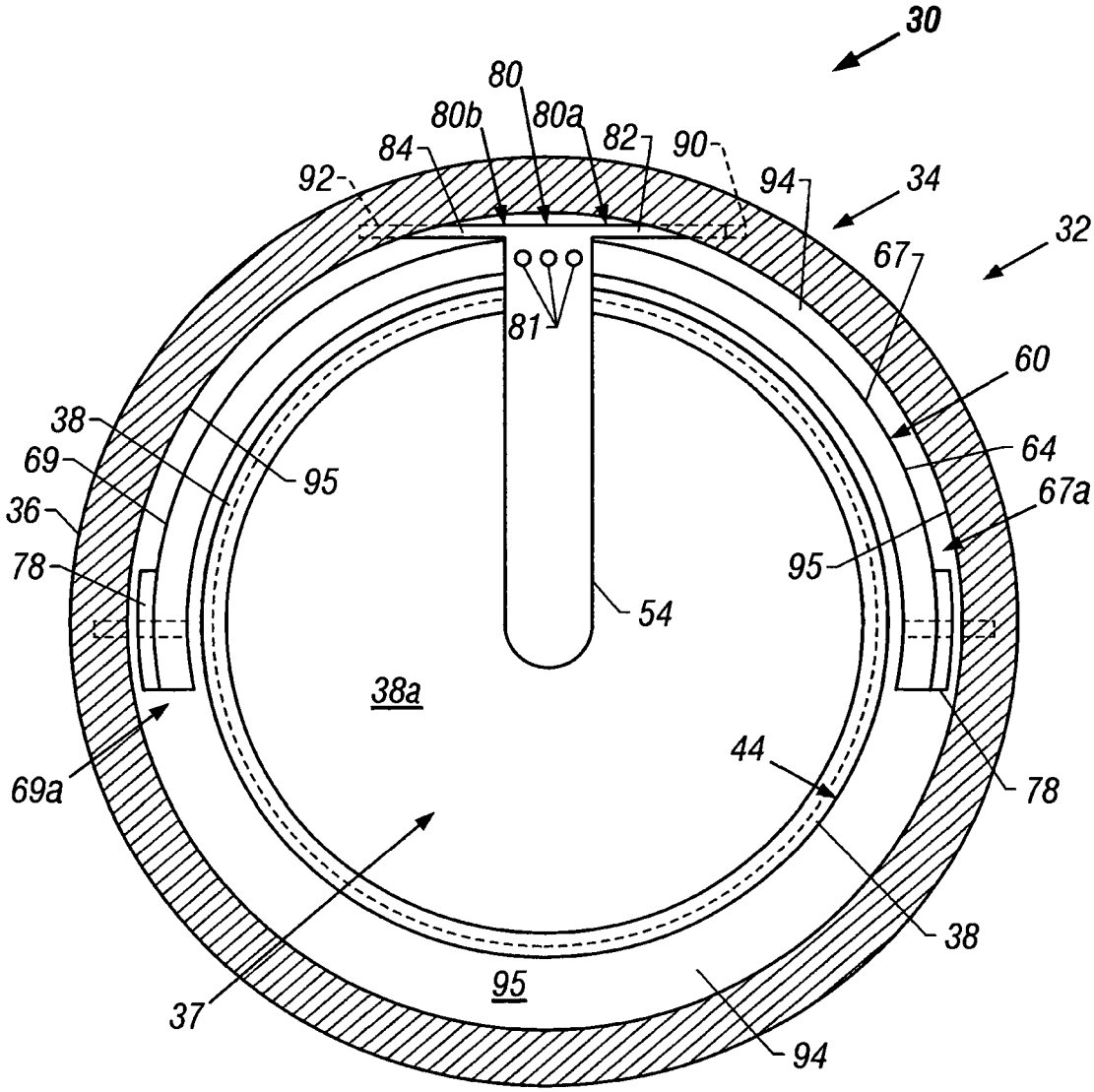
FIG. 10 is a sectional bottom view of the shiftable member closing device of FIG. 9.

Referring now to FIGS. 9 and 10, another embodiment of a shiftable member closing device 60 in accordance with the present invention is shown in use with a flapper type valve assembly 34, but not in a dual spring configuration. The illustrated shiftable member closing device 60 includes a unitary elastically deformable member 64 having a generally semi-circular shape and a generally circular cross-section. However, the member 64 is not limited to such shapes, but may have any suitable overall shape, cross-section and configuration. The elastically deformable member 64 is connected at or near its mid-point with a pivotable arm assembly 80, such as with the use of bolts 81, matable members or other mechanical connectors. Any other suitable connection technique or mechanism may be used, or the member 64 and assembly 80 may be integrally formed.

The elastically deformable member 64 includes left and right legs 67, 69 extending generally laterally from the left and right sides 80*a*, 80*b* of the pivotable arm assembly 80, respectively, and into a cavity, or cavities, 94 (FIG. 10) formed in the valve housing 36 at least partially around the circumference of the bore 44. The exemplary cavity or cavities 94 provide sufficient space to allow the legs 67, 69 to twist or deform therein without substantial resistance from the wall(s) 95 of the cavity or cavities 94 or with such resistance as may be desired. The legs 67, 69 are anchored to the valve housing 36 at or near their respective ends 67*a*, 69*a*, such as with the use of mounting brackets 78 and bolts (not shown). However, any other suitable technique or mechanism for connecting the legs 67, 69 to the housing 36 (or other suitable component) may be used.

The pivotable arm assembly 80 of FIGS. 9 and 10 includes an arm 54 that engages the flapper member 38 and transmits torque, or upward biasing forces, from the elastically deformable member 64 to the flapper member 38. In the illustrated embodiment, the arm 54 is a rigid metal member rigidly connected, such as by solder, to the bottom surface 38*a* of the flapper member 38, preferably along the centerline of the member 38. However, the arm 54 may be of any other suitable form and configuration, and may be associated with the shiftable valve member 37 in any suitable manner.

The illustrated pivotable arm assembly 80 also includes pins 82, 84 that enable pivoting of the assembly 80 and flapper member 38. The exemplary pins 82, 84 are also rigid metal members, and extend generally laterally from the left and right sides 80*a*, 80*b* of the assembly 80 into orifices 90, 92 formed in the valve housing 36, respectively. The exemplary pins 82, 84 are freely rotatable in the orifices 90, 92, forming the axis of rotation of the pivotable arm assembly 80 and the flapper member 38.

The assembly 80 and its components, the arm 54, pins 82, 84 (and possibly also elastically deformable member 64) may be formed integrally or in any other suitable manner. Further, the pivotable arm assembly 80 may have any other suitable configuration, components, form and operation.

In operation of the embodiment shown in FIGS. 9 and 10, as the flapper member 38 is opened, or moved from a closed position, the pins 82, 84 rotate within the orifices 90, 92, respectfully, and the pivotable arm assembly 80 and flapper member 38 pivot. The elastically deformable member 64 (being connected to the pivotable arm assembly 80) will move, or attempt to rotate along with the flapper member 38. Because the legs 67, 69 of the member 64 are anchored to the valve housing 36, the member 64 will resist rotation at ends 67*a*, 69*a* and will elastically deform, or twist, generating torque.

The torque of the elastically deformable member 64 is transferred to the pivotable arm assembly 80 and its arm 54, which transfers torque to the flapper member 38. As the opening, or downward force on the illustrated flapper member 38 is reduced or removed, the torque of the exemplary elastically deformable member 64 yieldably urges the arm 54 and flapper member 38 into a closed position. When the flapper member 38 is in a closed position, the exemplary elastically deformable member 64 will have residual torsional stress sufficient to retain the flapper member 38 in a closed position. Under normal operating conditions, the biasing force of the member 64 will cause the flapper member 38 to remain in a closed position. To open the flapper member 38, downward force must be applied to the member 38 sufficient to overcome the biasing forces of the elastically deformable member 64.

It should be understood that exemplary methods of operation of the above-described embodiments and other embodiments of the present invention need not include all of the features and operations described above, and such operations need not be performed in any particular order, such as the order provided above. Further, the methods of the present invention do not require use with the particular embodiments shown and described in the present specification, such as the exemplary elastically deformable members, but are equally applicable with any other suitable structure, form and configuration of components. In addition, in every case, caution must be used in manufacturing, assembling, handling and operating any apparatus made or used in accordance with the present invention.

The elasticity and durability of the elastically deformable member(s) 64, such as shown in FIGS. 4 and 10, and the biasing forces provided thereby can be varied by modifying one or more variables, if desired. For example, the elasticity and durability of the members 64 are affected by the material composition thereof, which can thus be selected or changed to effect one or more of the above factors. For another example, the durability of the members 64 and the amount of biasing forces created thereby can be affected by the rigidity of the connection of the member(s) 64 to the other components. For example, referring to the embodiment of FIGS. 4 and 5, a non-rigid connection of the members 64 to the valve housing 36 will allow the back ends 68, 70 of the member 64 to flex or twist to a certain extent, thus generally reducing the stress on the members 64 and the torque and biasing forces generated thereby as compared to a rigid connection.

For yet another example, the cross-sectional shape of the elastically deformable member(s) 64 could be selected or modified to affect the torsional rigidity of the member(s) 64, and thus the material stress on the member(s) 64 and deformation behavior thereof. For example, a member 64 having a thin, elliptical cross-section would likely be more flexible than an otherwise similarly designed and situated member 64 having a circular cross-section.

Preferred embodiments of the present invention are thus well adapted to carry out one or more of the objects of the invention. Further, the apparatus and methods of the present invention offer advantages over the prior art that have not been specifically addressed herein but are, or will become, apparent from the description herein, the appended drawings and claims. In addition, it should also be understood that certain features and subcombinations of the present invention are of utility and may be employed without reference to other features and subcombinations. This is contemplated and within the scope of the appended claims.

While preferred embodiments of this invention have been shown and described, many variations, modifications and/or changes of the apparatus and methods of the present invention, such as in the components, details of construction and operation, arrangement of parts and/or methods of use, are possible, contemplated by the applicant, within the scope of the appended claims, and may be made and used by one of ordinary skill in the art without departing from the spirit or teachings of the invention and scope of appended claims. Because many possible embodiments may be made of the present invention without departing from the scope thereof, it is to be understood that all matter herein set forth or shown in the accompanying drawings is to be interpreted as illustrative and not limiting. Accordingly, the scope of the invention and the appended claims is not limited to the embodiments described and shown herein.

What is claimed is:

1. A safety valve for use in an oilfield tubular, the safety valve comprising:

a housing having a longitudinal bore extending therethrough, a flapper valve member mounted in said housing and being hingeably movable relative to said longitudinal bore, said flapper valve member having an open position allowing fluid flow through said longitudinal bore and a closed position disallowing fluid flow through said longitudinal bore, and first and second springs engageable with said flapper valve member, said second spring including at least one elastically deformable member being elongated around a path that follows the circumference of said longitudinal bore and being non-coiled along its entire length, said at least one elongated elastically deformable member being associated with said flapper valve member at one location and with said housing at least one other location, whereby said first and second springs provide biasing forces to move said flapper valve member into a closed position.

2. The safety valve of claim 1 wherein said second spring includes first and second elongated elastically deformable members, each of said first and second elongated elastically deformable members having first and second ends and being connected at its first end to said flapper valve member and at its second end to said housing.

3. A subsurface safety valve for use in an oilfield tubular, the subsurface safety valve comprising:

housing means having a longitudinal bore extending therethrough, shiftable valve means mounted in said housing means for allowing and disallowing fluid flow through said longitudinal bore, said shiftable valve means having an open position capable of allowing fluid flow through said longitudinal bore and a closed position capable of at least partially blocking fluid flow through said longitudinal bore, and first and second spring means for urging said shiftable valve means into a closed position and retaining it in the closed position, said second spring means being non-coiled about its entire length, elastically deformable and elongated about a path that follows the circumference of said longitudinal bore.

4. The safety valve of claim 1, further comprising:

a hinge mounted to the flapper valve member and the housing, wherein said at least one non-coiled elongated elastically deformable member extends at least partially around the circumference of the longitudinal bore so that the hinge is located between the deformable member and the bore.

5. The safety valve of claim 4, wherein said at least one non-coiled elongated elastically deformable member extends approximately one hundred eighty degrees around the circumference of the longitudinal bore.

6. The safety valve of claim 4, wherein the housing comprises pockets located on either side of the hinge, and said at least one non-coiled elongated elastically deformable member is disposed in the pockets.

7. The subsurface safety valve of claim 3, wherein the shiftable valve means comprises a flapper, the subsurface safety valve further comprising:

hinge means for pivotably mounting the flapper to the housing means, wherein the second spring means extends at least partially around the circumference of the longitudinal bore so that the hinge means is located between the second spring means and the bore.

8. The subsurface safety valve of claim 7, wherein said at least the second spring means extends approximately 180° round the circumference of the longitudinal bore.

9. The subsurface safety valve of claim 7, wherein the housing means comprises pockets located on either side of the hinge means, and said the second spring means is disposed in the pockets.

10. A safety valve usable with a well, comprising:

a housing having a longitudinal bore;

a flapper valve member pivotably mounted to the housing to have an open position and a closed position;

at least one elastically deformable member disposed being elongated about a path that follows the circumference of said longitudinal bore and being non-coiled along its entire length to provide a biasing force directed to moving the flapper valve member to the closed position;

a hinge mounted to the flapper valve and the housing;

wherein said at least one non-coiled elongated elastically deformable member extends at least partially around the circumference of a longitudinal bore that extends through the housing so that the hinge is located between the deformable member and the bore; and wherein said at least one non-coiled elongated elastically deformable member extends approximately one hundred eighty degrees around the circumference of the longitudinal bore.

11. A safety valve usable with a well, comprising:

a housing having a longitudinal bore;

a flapper valve member pivotably mounted to the housing to have an open position and a closed position;

at least one elastically deformable member disposed being elongated about a path that follows the circumference of said longitudinal bore and being non-coiled alone its entire length to provide a biasing force directed to moving the flapper valve member to the closed position;

a hinge mounted to the flapper valve and the housing;

wherein said at least one non-coiled elongated elastically deformable member extends at least partially around the circumference of a longitudinal bore that extends through the housing so that the hinge is located between the deformable member and the bore; and wherein the housing comprises pockets located on either side of the hinge, and said at least one non-coiled elongated elastically deformable member is disposed in the pockets.

12. A method usable with a well, comprising:

pivotably coupling a flapper valve member to a housing, wherein the act of coupling comprises mounting a hinge to the flapper valve member and the housing, using at least one elongated elastically deformable member being substantially flat when not deformed and disposed at least partially around the circumference of a longitudinal bore to provide a biasing force directed to moving the flapper valve member to a closed position; and extending, said at least one non-coiled elongated elastically deformable member at least partially around the circumference of a longitudinal bore that extends through the housing so that the hinge is located between the deformable member and the bore; and extending said at least one non-coiled elongated elastically deformable member approximately one hundred eighty degrees round the circumference of the longitudinal bore.

13. A method usable with a well, comprising:

pivotably coupling a flapper valve member to a housing, wherein the act of coupling comprises mounting a hinge to the flapper valve member and the housing, using at least one elongated elastically deformable member being substantially flat when not deformed and disposed at least partially around the circumference of a longitudinal bore to provide a biasing force directed to moving the flapper valve member to a closed position; and extending said at least one non-coiled elongated elastically deformable member at least partially round the circumference of a longitudinal bore that extends through the housing so that the binge is located between the deformable member and the bore;

forming pockets on either side of the hinge; and placing said at least one non-coiled elongated elastically deformable member in the pockets.

* * * * *